US007083155B1

(12) United States Patent
Smartt

(10) Patent No.: US 7,083,155 B1
(45) Date of Patent: Aug. 1, 2006

(54) ADJUSTABLE READING BOOKSTAND

(76) Inventor: Loyce Smartt, 903 Drew St. #123, Brooklyn, NY (US) 11208

( * ) Notice: Subject to any disclaimer, the term of this patent is extended or adjusted under 35 U.S.C. 154(b) by 78 days.

(21) Appl. No.: 11/052,690

(22) Filed: Nov. 8, 2004

Related U.S. Application Data

(63) Continuation-in-part of application No. 10/112,576, filed on Mar. 29, 2002, now abandoned.

(60) Provisional application No. 60/280,102, filed on Mar. 29, 2001.

(51) Int. Cl.
*A47B 19/00* (2006.01)

(52) U.S. Cl. ..... 248/441.1; 248/445; 248/457; 248/451

(58) Field of Classification Search ..... 248/441.1, 248/445, 447, 448, 449, 451, 452, 453, 454, 248/458
See application file for complete search history.

(56) References Cited

U.S. PATENT DOCUMENTS 2,638,701 A * 5/1953 Dahlgren ..... 248/445
3,779,504 A * 12/1973 Schwartz et al. ..... 248/441.1
3,790,770 A * 2/1974 Stern ..... 362/98
4,436,271 A * 3/1984 Manso ..... 248/460
5,058,848 A * 10/1991 Ferraro ..... 248/444.1
5,351,927 A * 10/1994 Howell ..... 248/444.1
5,649,683 A * 7/1997 Ahn ..... 248/453
5,855,329 A * 1/1999 Pagano ..... 248/451
5,857,654 A * 1/1999 Berman ..... 248/441.1
5,971,343 A * 10/1999 Marlak ..... 248/441.1
5,979,858 A * 11/1999 Bronson ..... 248/452
6,045,107 A * 4/2000 Carlson ..... 248/445
6,220,559 B1 * 4/2001 Chow ..... 248/445
6,250,599 B1 * 6/2001 Goldberg ..... 248/444.1
6,367,760 B1 * 4/2002 Pagano ..... 248/451
2003/0160144 A1 * 8/2003 Guadagnini ..... 248/447

* cited by examiner

*Primary Examiner*—Ramon O Ramirez
(74) *Attorney, Agent, or Firm*—Robert W.J. Usher

(57) ABSTRACT

A bookstand has a pivotally adjustable book holder having a frame with upper and lower book supporting plates slidable across each other to provide a book supporting surface of variable size for supporting spines and rear covers of open books of different sizes. The upper plate has a clasp for a central upper edge of an open book and the lower plate has a lower ledge supporting a lower edge of the book and formed with differently spaced sockets receiving plugs to trap open stacks of pages on both sides of an open book by engaging outermost pages exposed for reading, even when a reader is supine. Removing and transferring plugs between sockets releases trapped pages for turning and transfer of plugs between sockets accommodates progressive changes in cumulative total thickness of the stacks of pages on respective opposite sides of the book as the pages are turned during reading.

12 Claims, 2 Drawing Sheets

3
35'
36'
7
41
15
38
14
19
39
42
13
43
45
30'
37
30
32'
44
46
1
47
2
48
49

3
3
6'
6
7
11
9
10
12
12'
42
39
4
32'
30'
15
30
32

ADJUSTABLE READING BOOKSTAND

RELATED APPLICATIONS

This is a continuation-in-part application of my application Ser. No. 10/112,576 filed Mar. 29, 2002 now abandoned which claims priority from my provisional application No. 60/280102, filed Mar. 29, 2001, the disclosures of both applications being incorporated herein by reference.

FIELD OF THE INVENTION

The invention relates to bookstands which are adjustable particulary but not solely to accommodate individuals with physical disabilities or conditions which prevent them holding a book comfortably and require different reading positions.

Many such disabilities and conditions including arthritis, strokes, work related stresses, and spinal cord injuries are referenced in my parent application.

BACKGROUND OF THE INVENTION

The prior art documents numerous attempts over many years to provide adjustable bookstands.

For example, U.S. Pat. No. 2,635,701 issued in 1949 to Dahigren and U.S. Pat. No. 6,220,559 issued April 2001 to Choy teach bookstands for mounting on hospital beds to retain a book in different positions for reading by a supine patient while U.S. Pat. No. 3.790,770 issued in 1974 to Stern; U.S. Pat. No. 5,058,848 issued in 1991 to Ferraro; and, U.S. Pat. No. 5,351,927 issued in 1994 to Howell teach free standing versions.

Although several of the above-noted patents teach book holders which are adjustable to accommodate books of different thicknesses, none make adequate provision to accommodate progressively differing thicknesses of each side of the book as a result of turning over the pages from one side of the book to the other during reading.

For example, none is adjustable to hold lower edge portions pages on the side of the book which is of reduced thickness stable and flat In all reading positions.

SUMMARY OF THE INVENTION

An object of the invention is to provide a book holder for a bookstand which can accommodate progressively differing thicknesses of each side of the book formed by turning over the pages from one side of the book to the other during reading.

Another object of the invention is to provide a bookstand which can position a book in a variety of different positions for reading while retaining the pages on both sides of an open book stable, in reading positions.

According to one aspect, the invention provides a bookstand comprising:

a book holder and means for mounting the book holder in a book reading position;

the book holder comprising:

a frame comprising at least one plate providing a book supporting surface for supporting a rear cover of a book and having a lower free edge provided with an outstanding flange-form ledge for supporting a lower edge portion of the book in a reading position;

the book supporting ledge having an array of sockets spaced at respective different distances from the lower free edge of the lower plate and at different distances from opposite lateral ends of the ledge;

and a plurality of plugs for insertion in selected of said sockets thereby to engage outermost pages exposed for reading on both sides of an open book on the ledge and trap underlying stacks of pages on both sides adjacent the book supporting surface thereby maintaining the lower portion of the book in an open position on the frame with exposed pages in a reading position, removal of an plug releasing a trapped page for turning by the reader and transfer of plugs to different sockets at different spacings apart from the book supporting surface accommodating progressive changes in the cumulative total thickness of the stacks of pages on respective sides of the book as the pages are turned during reading.

Thus, transfer of the plugs between selected appropriately positioned sockets enables the exposed pages on opposite sides of the book to be trapped in an optimal reading position or maintained flat, adjacent the book supporting surface at all stages of reading the book while an individual plug can easily be removed and replaced to permit turning a page.

Maintaining the pages flat may be particularly desirable when reading the book through a magnifying lens which may be fixed to the front of the book holder. Advantageously, the sockets comprise slots and the plugs comprise plates of triangular shape forming tapering corners that can be inserted in respective slots with sides of the plugs engaging exposed pages of opposite sides of an open book in the book holder.

Forming the plugs as plates enables them to be mass produced economically from sheet metal by simple, conventional metal stamping. In addition, they are easily handled by the reader and provide desirably broad surfaces for engaging an exposed page securely.

Desirable, a corner of each plate is formed with a tie receiving retention aperture and associated, respective, tie receiving retention apertures are formed in the book supporting ledge adjacent respective opposite free longitudinal ends for receipt of respective ties to attach respective plugs to the book holder whilst permitting insertion and removal thereof from respective apertures.

Thus, the plugs remain captured during use, preventing loss.

It is further preferred that the triangular shape forms a right angled triangle, providing a long side and two short sides and the aperture is formed in a corner formed by the short sides whereby insertion of the corner defined by the short sides into a slot presents a long side surface for engagement with an exposed page and insertion of a corner defined by a short side and a long side presents a short side surface for engagement with an exposed page. This enables adjustment for books of different page resiliency and size simply by changing insertion position.

In a preferred form, the book supporting plate comprises an upper plate and a lower plate and comprises means mounting the plates for progressive, vertical, sliding movement across each other in overlapping, parallel relation so that they cooperate to provide a book supporting surface adjustable in size for supporting a spine and rear covers (a rear/back side) of open books of different sizes.

The plates cooperate to defines a vertically extending channel having divergent sidewalls for seating a spine and opposite rear sides of an open book snugly therein, ensuring stable retention.

In one advantageous embodiment, the upper plate extends rearwardly of the lower plate and the mounting means comprises at least one adjustment slot extending vertically across the upper plate and at least one threaded post protruding rearwardly from a rear side of the lower plate into said at least one adjustment slot for sliding adjustment therealong and at least one manually operable clamping nut on said at least one threaded post for clamping the upper plate against the lower plate with the post in a selected postion along the adjustment slot.

This enables reliable adjustment which is relatively simple both in terms of operation and construction.

In one embodiment particularly suited for use by an individual in a supine position, for example, when reading lying on their back in bed, the upper plate has an upper free edge remote from the lower plate provided with a manually operable clip for clasping engagement with an upper edge portion of an open book by urging the upper edge portion of the book against the book supporting surface, thereby to maintain the upper edge portion in an open position with the back of the book abutting the book supporting surface.

BRIEF DESCRIPTION OF THE DRAWINGS

In order that the invention may be readily understood, specific embodiments thereof will now be described by way of example only and with reference to the accompanying drawings in which:

As shown in FIGS. 1, 4 and 5, the bookstand comprises a book holder 1 mounted on a free standing stand assembly 2.

Figure 1:
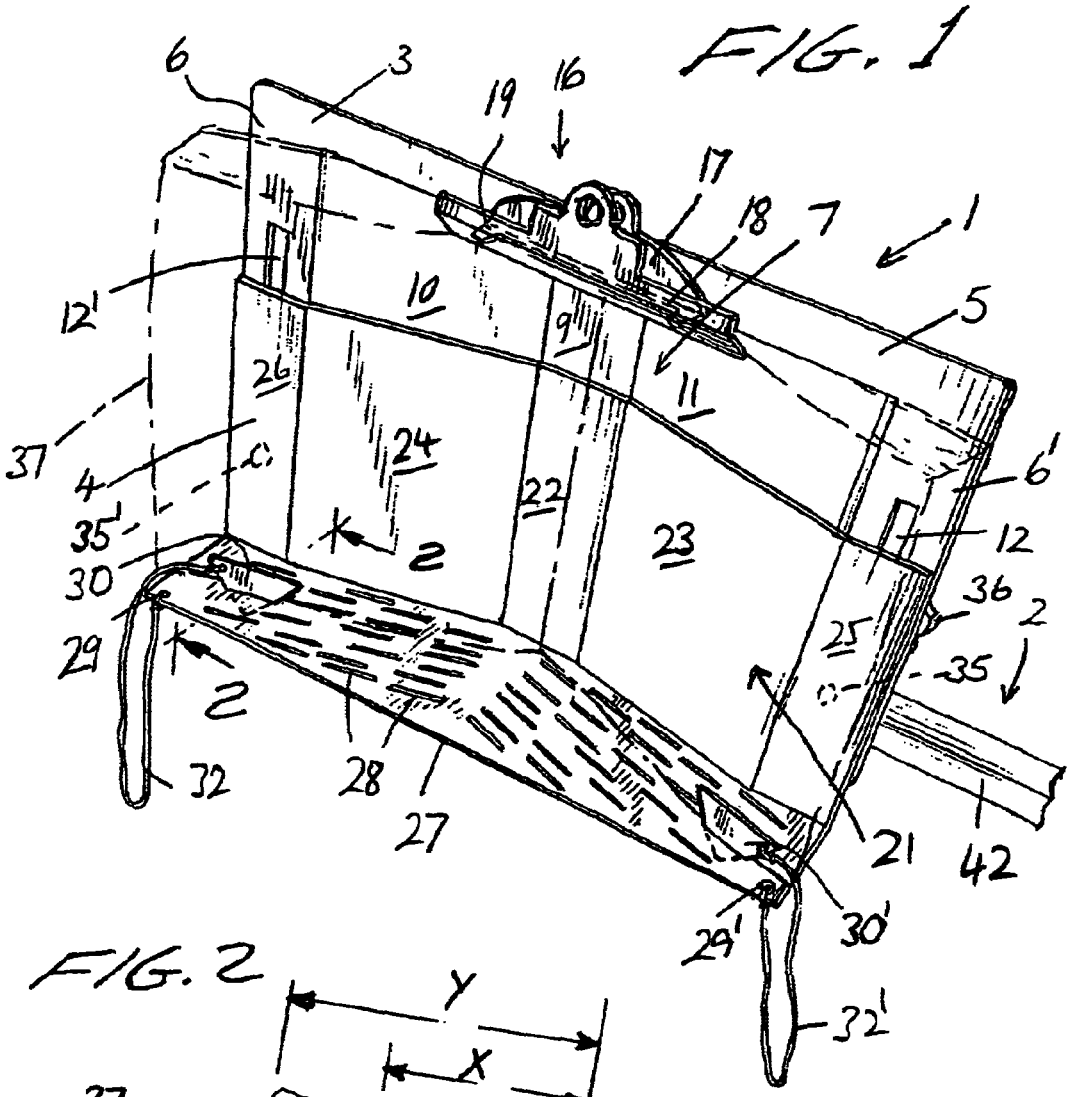
FIG. 1 is a perspective view of a book holder of the bookstand according to the invention.
Figure 2:
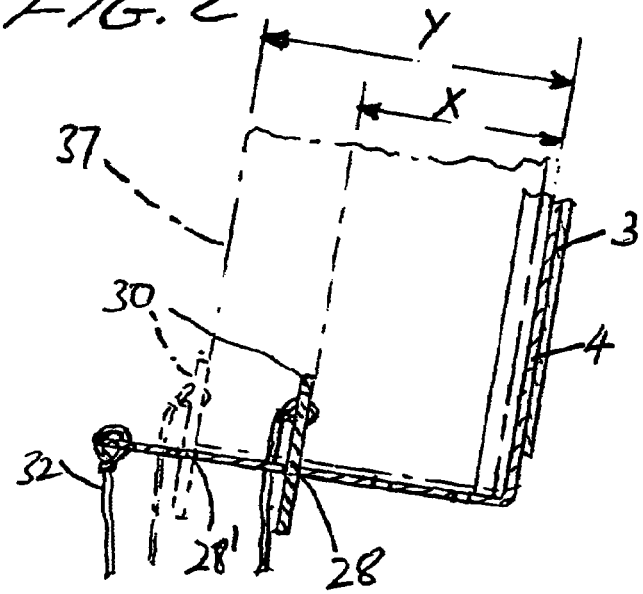
FIG. 2 is a fragmentary cross-sectional view taken along lines 2—2 of FIG. 1.
Figure 3:
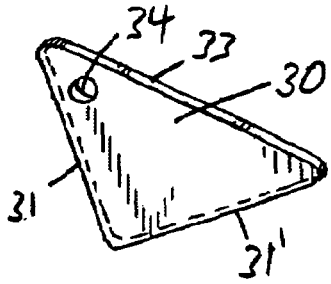
FIG. 3 is a perspective view of an individual plug.
Figure 4:
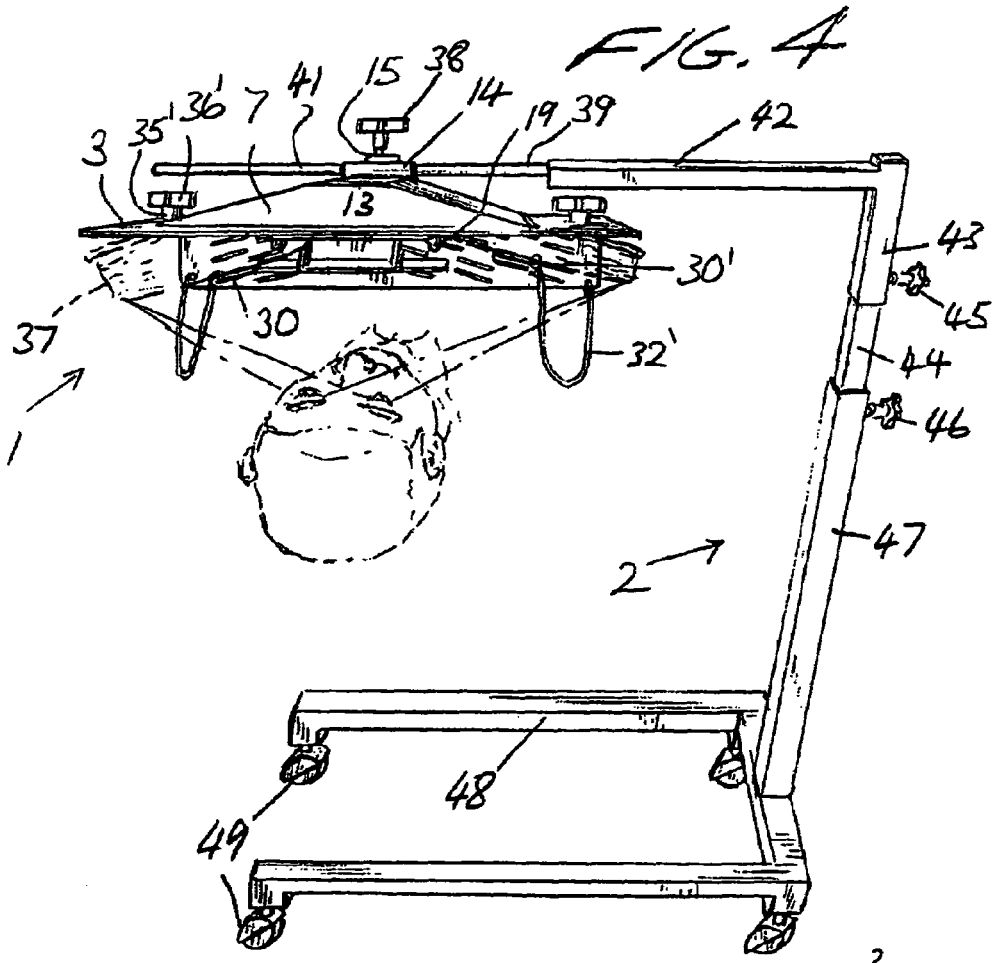
FIG. 4 is a perspective view of the bookstand with the book holder pivoted into a horizontal plane for holding a book face down for a supine reader; and, FIG. 5 is a rear view of the book holder.
Figure 5:
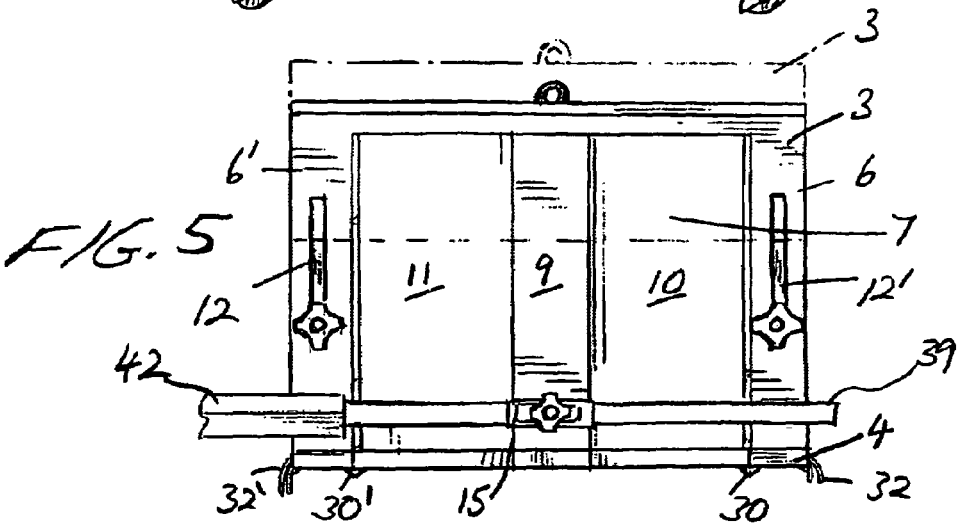

The book holder comprises an assembly of two main parts an upper, rear plate 3 and a lower, front plate 4 which cooperate to provide a surface for supporting the back of an open book 37, indicated in broken lines in FIGS. 1, 2 and 4.

The upper plate comprises an outer frame formed by horizontal upper strip 5 form respective opposite ends of which depend vertical frame strips 6 and 6' a central book supporting portion 7 forming a vertically extending, book receiving channel having a base 9 and opposite divergent sidewalls 10 and 11 which have outer longitudinal edges attached by welding to respective inner longitudinal edge portions of the vertical frame strips 6 and 6', respectively. The book receiving channel is closed at a top by an end wall 13, as shown in FIG. 4. Vertically extending assembly slots 12 and 12' are formed along respective vertical frame strips 6 and 6'.

A clamping sleeve 14 with a nut is attached (welded) to a rear surface of the upper plate and a threaded knob 38 engaged therein for clamping the book holder at various angular positions.

A clipboard type clip 16 is mounted on the top of the upper plate 3 by a rear jaw 17 of the clip 16 being attached to the horizontal frame strip 5 so that the front jaw can engage the face of the open book 37 adjacent an upper edge portion thereof to clasp the book against the book supporting surface of the upper plate 3. Tabs 19 forming book guides are bent forwards from opposite longitudinal ends of the rear jaw 17 in alignment with the upper end of the book receiving channel to abut an upper edge of a book inserted between the clip jaws 17, 18 to prevent over insertion and guide the book into the book receiving channel.

The lower plate 4 comprises a central book supporting portion 21 formed into a similar channel shape to the channel of the upper plate for nesting therewith, having a base 22 and opposite divergent sidewall 23, 24 with outer edges connected respectively to vertical strip portions 25 and 26. A flange-form, book supporting ledge 27 outstands from a lower edge of the lower plate for supporting a lower edge portion of the book In the book holder in a reading position.

The book supporting ledge 27 is formed with an array of slot-form sockets 28, 28' spaced at respective different distances from the lower free edge of the lower plate and at different distances from opposite lateral ends of the ledge 27 and tie receiving retention apertures or eyes 29, 29' are formed In opposite longitudinal corners of the ledge 27.

Page trapping plugs 30, 30' are provided for insertion in selected of said sockets 28, 28'. The plugs comprise plates of right angle, isosceles triangular shape forming tapering corners providing two short sides 31, 31' and 32 and a long side 33 (hypotenuse). A tie receiving, retention aperture 34 is formed in one formed by the short sides. Ties 32, 32' extend through respective apertures 29 and 34 in the ledges and plugs to ensure that the plugs remain captured to the ledge when removed from the slots 28.

The plugs engage outermost pages exposed for reading on both sides of an open book on the ledge and trap underlying stacks of pages on both sides adjacent the book supporting surface thereby maintaining the lower portion of the book in an open position on the frame with exposed pages in a reading position, removal of an plug releasing a trapped page for turning by the reader and transfer of plugs to different sockets at different spacings apart from the book supporting surface accommodating progressive changes in the cumulative total thickness of the stacks of pages on respective sides of the book as the pages are turned during reading.

As can be seen by comparing FIGS. 1, 2 and 4, as a result of pages being turned, the total thickness of the pages on the right side of the book 37 in FIG. 1 is progressively reduced and the total thickness of the pages accumulated on the left side increased proportionately, from the thickness shown in broken lines in FIG. 1 to the thicknesses shown in broken lines In FIG. 4, respectively, and in FIG. 2 from thickess X to thickness Y. This differential is accommodated by transferring a plug 30 on the left side from a slot 28 to a slot 28' spaced further away from the book supporting surface, as shown in broken lines in FIG. 2 and an plug 30' into a slot on the right side closer the book supporting surface thereby to trap the stacks of pages against the book supporting surfaces, maintaining the exposed pages flat for reading and reliably retaining the book in the book holder even when positioned horizontally.

Insertion the corner defined by the short sides 31, 31' into a slot 28 or 28' presents a long side surface adjacent edge 33 for engagement with an exposed page and insertion of a corner defined by the short side 31' and the long side 33 presents a short side surface for engagement with an exposed page enabling selection to suit pages of different sizes and resiliencies.

Threaded posts 35, 35' are attached to rear surfaces of respective strip portions 25 and 26 of the lower plate and protrude rearward into respective adjustment slots 12, 12' for sliding adjustment therealong and clamped in selected positions by manually operable clamping nuts or knobs mounted on free ends thereof. Thus, the plates 3, 4 can be progressively slid vertically over each other in overlapping parallel relation so that they cooperate to form a book supporting surface adjustable in size to support open books of different heights.

The free standing stand assembly 2 comprises a horizontally extending rod 39 having one end clamped in the sleeve 14 and the other end secured within to a tubular arm 42 extending horizontally from the top of a post portion 43 which receives telescopically an upper end of a vertical shaft 44, a lower end of which is received telescopically in an upper end of another tubular post 47 which upstands from a horizontal U-shape base leg structure 48 supported by castors 49. The stand is clamped at a selected height by screw-knobs 45 and 47 engaged in nuts weld to transverse bores in tubular members 43 and 47.

The invention claimed is:

1. A bookstand comprising:

a book holder and means for mounting the book holder in a book reading position;

the book holder comprising:

a frame comprising at least one plate providing a book supporting surface for supporting a rear cover of a book and having a lower free edge provided with an outstanding flange-form, elongate ledge for supporting a lower edge portion of the book in a reading position;

the book supporting ledge having an array of sockets spaced at respective different distances from the lower free edge of the lower plate and at different distances from opposite lateral ends of the ledge;

and a plurality of plugs for insertion in selected of said sockets thereby to engage outermost pages exposed for reading on both sides of an open book on the ledge and trap underlying stacks of pages on both sides adjacent the book supporting surface thereby maintaining the lower portion of the book in an open position on the frame with exposed pages in a reading position, removal of a plug releasing a trapped page for turning by the reader and transfer of plugs to different sockets at different spacings apart from the book supporting surface accommodating progressive changes in the cumulative total thickness of the stacks of pages on respective sides of the book as the pages are turned during reading.

2. A bookstand according to claim 1 wherein the sockets comprise slots and the plugs comprise plates of triangular shape forming tapering corners that can be inserted in respective slots with sides of the plugs engaging exposed pages of opposite sides of an open book in the book holder.

3. A bookstand according to claim 2 wherein a corner of each plate is formed with a retention aperture and associated retention apertures are formed in the book supporting ledge adjacent respective opposite free side ends for receipt of respective ties fastened to respective retention apertures in the plugs to attach the plugs to the book holder while permitting insertion and removal of the plugs from respective apertures.

4. A bookstand according to claim 3 wherein the triangular shape forms a right angled triangle, providing a long side and two short sides and the aperture is formed in a corner formed by the short sides whereby insertion of the corner defined by the short sides into a slot presents a long side for engagement with an exposed page and insertion of a corner defined by a short side and a long side presents a short side for engagement with an exposed page.

5. A bookstand according to claim 1 wherein said at least one plate comprises an upper plate and a lower plate and comprising means mounting the plates for progressive, vertical, sliding movement across each other in overlapping, parallel relation so that the plates cooperate to provide a book supporting surface adjustable in size for supporting a spine and rear covers of open books of different sizes.

6. A bookstand according to claim 5 wherein the upper and lower plates cooperate to defines a vertically extending channel having divergent sidewalls for seating a spine and opposite rear sides of an open book snugly therein.

7. A bookstand according to claim 5 wherein the upper plate extends rearwardly of the lower plate and the mounting means comprises at least one adjustment slot extending vertically across the upper plate and at least one threaded post protruding rearwardly from a rear side of the lower plate into said at least one adjustment slot for sliding adjustment therealong and at least one manually operable clamping nut on said at least one threaded post for clamping the upper plate against the lower plate with the post in a selected position along the adjustment slot.

8. A bookstand according to claim 5 wherein said upper plate has an upper free edge remote from the lower plate provided with a manually operable clip for clasping engagement with an upper edge portion of an open book by urging the upper edge portion of the book against the book supporting surface thereby to maintain the upper edge portion in an open position with the back of the book abutting the book supporting surface.

9. A bookstand according to claim 1 wherein said at least one plate defines a vertically extending channel having divergent sidewalls for seating a spine and opposite rear sides of an open book snugly therein.

10. A bookstand according to claim 1 wherein the mounting means comprises a telescopic post assembly having an upper end with an arm extending horizontally, cantilever fashion therefrom, a free end of the arm being pivotally connected to the book holder, whereby a vertical position of the book holder and an angular inclination of the book holder are altered by telescopic adjustment of the post assembly and pivotal adjustment on the arm, respectively.

11. A bookstand according to claim 10 wherein a lower end of the post is supported by wheel mounted, horizontally extending leg members.

12. A bookstand comprising:

a book holder for holding individual books of different sizes open in a reading position so that the individual book can be read and means for mounting the book holder in a book reading position;

the book holder comprising:

a frame comprising an upper book supporting plate and a lower book supporting plate;

means mounting the plates for progressive, vertical, sliding movement across each other in overlapping, parallel relation so that they cooperate to provide a book supporting surface of variable size for supporting a spine and rear covers of open books of different sizes;

the upper plate having an upper free edge remote from the lower plate and provided with a manually operable clasp for clasping engagement with an upper edge portion of an open book by urging the upper edge portion of the book against the book supporting surface thereby to maintain the upper edge portion in an open position with the back of the book abutting the book supporting surface; and, the lower plate having a lower free edge remote from the upper plate provided with an outstanding, flange form, elongate ledge for supporting a lower edge portion of the book;

the book supporting ledge having an array of sockets spaced at respective different distances from a lower free edge of the lower plate and at different distances from opposite longitudinal ends of the ledge;

and a plurality of plugs for insertion in selected of said sockets thereby to engage outermost pages exposed for reading on both sides of an open book on the ledge and trap underlying stacks of pages on both sides adjacent the book supporting surface thereby maintaining the lower portion of the book in an open position on the frame with exposed pages in a reading position, removal of a plug releasing a trapped page for turning by the reader and transfer of plugs to different sockets at different spacings apart from the book supporting surface accommodating progressive changes in the cumulative total thickness of the stacks of pages on respective sides of the book as the pages are turned during reading; and the mounting means mounting the book holder for pivotal movement between a vertical plane and a horizontal plane with the book supporting surface facing downwards for a user to read a book when upright and when supine, respectively.

* * * * *